US009663910B2

(12) United States Patent
Muntasser et al.

(10) Patent No.: US 9,663,910 B2
(45) Date of Patent: May 30, 2017

(54) FLAT ROOF SNOW THROWER

(71) Applicants: Emadeddin Zahri Muntasser, Braintree, MA (US); Farris Emadeddin Muntasser, Braintree, MA (US)

(72) Inventors: Emadeddin Zahri Muntasser, Braintree, MA (US); Farris Emadeddin Muntasser, Braintree, MA (US)

( * ) Notice: Subject to any disclaimer, the term of this patent is extended or adjusted under 35 U.S.C. 154(b) by 38 days.

(21) Appl. No.: 14/823,276

(22) Filed: Aug. 11, 2015

(65) Prior Publication Data

US 2016/0281310 A1 Sep. 29, 2016

Related U.S. Application Data

(60) Provisional application No. 62/138,767, filed on Mar. 26, 2015.

(51) Int. Cl.

| | |
|---|---|
| ***E01H 5/09*** | (2006.01) |
| ***E01H 5/04*** | (2006.01) |
| ***E01H 5/06*** | (2006.01) |
| ***E04D 13/10*** | (2006.01) |

(52) U.S. Cl.

CPC ..... *E01H 5/098* (2013.01); *E01H 5/045* (2013.01); *E01H 5/061* (2013.01); *E04D 13/106* (2013.01)

(58) Field of Classification Search

CPC .... E01H 5/08; E01H 5/09; E01H 5/00; E01H 5/04; E01H 5/015; E01H 5/098; E01H 5/061; E04D 13/106

See application file for complete search history.

(56) References Cited

U.S. PATENT DOCUMENTS

| | | | | |
|---|---|---|---|---|
| 181,964 | A | 9/1876 | Mullaly et al. | |
| 2,623,308 | A * | 12/1952 | Lamy | E01H 5/098 37/251 |
| 2,977,694 | A * | 4/1961 | Higby | E01H 5/04 37/243 |
| 3,468,041 | A | 9/1969 | Mattson et al. | |
| 3,512,279 | A * | 5/1970 | Benson | E01H 5/04 123/41.64 |
| 3,886,675 | A | 6/1975 | Maisonneuve et al. | |
| 4,023,287 | A * | 5/1977 | de Brito | E01H 5/04 37/231 |
| 4,288,087 | A * | 9/1981 | Morrison | B62B 17/00 180/182 |
| 4,365,430 | A | 12/1982 | Myerly | |

(Continued)

FOREIGN PATENT DOCUMENTS

| | | |
|---|---|---|
| CA | 1196348 | 11/1985 |
| CA | 2808878 | 9/2013 |

(Continued)

*Primary Examiner* — Jamie L McGowan

(74) *Attorney, Agent, or Firm* — Lambert & Associates; Gary E. Lambert; David J. Connaughton, Jr.

(57) ABSTRACT

A snow clearing machine is configured for operation on flat roofs and is designed to not damage the roof on which it is operated. The snow clearing machine is configured to leave a layer of snow beneath it, clearing the remainder, so that the machine avoids contact with the roof. As such, the snow clearing machine may be used on a flat roof or other fragile surface without damaging it.

17 Claims, 7 Drawing Sheets

(56) References Cited

U.S. PATENT DOCUMENTS 4,391,052 A * 7/1983 Guy, Jr. ..... E01H 5/098 37/236
4,744,582 A * 5/1988 Wykhuis ..... A01B 63/10 172/244
5,101,585 A * 4/1992 Gerbrandt ..... E01H 5/04 37/249
5,410,824 A * 5/1995 Pedersen ..... E01H 5/04 37/214
5,438,770 A 8/1995 Miller
6,131,316 A * 10/2000 Yoshina ..... E01H 5/04 37/242
6,182,383 B1 * 2/2001 Reed, Jr. ..... A01G 1/125 15/340.2
6,275,757 B1 * 8/2001 Watanabe ..... E02F 3/437 172/6
6,560,905 B2 5/2003 Monroe
7,137,214 B2 * 11/2006 Hoerle ..... E01H 10/007 239/663
7,552,976 B2 6/2009 Brown
8,191,289 B2 6/2012 Raftery
8,584,383 B1 * 11/2013 Morse ..... E01H 5/098 37/242
2003/0173752 A1 * 9/2003 Veeser ..... B60P 3/062 280/35
2003/0182823 A1 * 10/2003 Sanders ..... E02F 5/14 37/244
2004/0194353 A1 * 10/2004 Hoerle ..... E01H 10/007 37/219
2005/0066553 A1 3/2005 Light
2005/0166589 A1 * 8/2005 Sakikawa ..... A01D 69/03 60/487
2006/0087185 A1 * 4/2006 Patridge ..... B60K 25/00 310/92
2006/0102403 A1 * 5/2006 Inoguchi ..... B62M 27/02 180/190
2006/0245873 A1 * 11/2006 Black ..... B60S 13/00 414/458
2007/0063501 A1 * 3/2007 Majkrzak ..... E02F 9/085 280/763.1
2008/0155865 A1 * 7/2008 Mills ..... E01H 5/066 37/275
2009/0064543 A1 * 3/2009 Azure ..... E02F 3/085 37/352
2010/0037491 A1 * 2/2010 Parker ..... E01H 5/106 37/197
2010/0236106 A1 * 9/2010 Muscarella ..... E01H 5/098 37/196
2010/0313451 A1 * 12/2010 Trubiano ..... E01H 5/104 37/228
2011/0202224 A1 * 8/2011 Thompson ..... G05D 1/0227 701/26
2011/0315465 A1 12/2011 Henry
2012/0174525 A1 * 7/2012 Hinshaw ..... B25F 5/00 52/741.1
2012/0192606 A1 * 8/2012 Quast ..... C05F 3/00 71/21
2012/0246977 A1 * 10/2012 Proeber ..... E02F 3/841 37/197
2014/0121881 A1 * 5/2014 Diazdelcastillo ..... A01D 42/00 701/23
2014/0180478 A1 * 6/2014 Letsky ..... E01H 5/098 700/258
2014/0202046 A1 * 7/2014 Yamazaki ..... E01H 5/098 37/249
2014/0250739 A1 * 9/2014 Distefanis, Jr. ..... E01H 5/045 37/260
2015/0107136 A1 * 4/2015 Fukano ..... E01H 5/098 37/235
2016/0281310 A1 * 9/2016 Muntasser ..... E01H 5/098

FOREIGN PATENT DOCUMENTS

CN 100447356 C 12/2008
CN 203782995 8/2014
DE 102006006856 8/2007
JP 2008190291 8/2008
JP 4719185 7/2011

* cited by examiner

FLAT ROOF SNOW THROWER

BACKGROUND OF THE INVENTION

Field of the Invention

The present invention relates generally to snow clearing machines. More particularly the present invention relates to a snow clearing machine for flat roofs having a motive structure and snow clearing mechanism positioned on the machine such that during proper snow clearing operation, no part of the machine makes contact with the roof.

Description of Related Art

As of today there seems to be no method of removing snow from flat roofs except by manually shoveling the snow off. The reason the typical snow thrower could not (and should not) be used is that any contact with the roof surface is likely to result in damage to the roof. Manual shoveling is also very risky and very slow. Typically we see crews of 10 to 20 people at a time frantically shoveling flat roofs. The cost of such manual labor could be as high as $100.00/hour per person. Even with plastic shovels, manual laborers are simply not able to keep these shovels away from the roof surface.

Therefore, what is needed is a snow clearing machine that makes no contact with a flat roof when in proper operation. A layer of about 4" or more of snow is left on roof. The modified snow clearing machine will glide over this layer of snow and remove only excess snow.

SUMMARY OF THE INVENTION

The subject matter of this application may involve, in some cases, interrelated products, alternative solutions to a particular problem, and/or a plurality of different uses of a single system or article.

In one aspect, a flat roof snow clearing machine is provided. The machine has a body which provides a primary structure of the machine, a pair of handles may extend from the body. A motor may be positioned within the body. A motive source is attached to the body and is in mechanical communication with the motor. The motive source provides a source of movement to the snow clearing machine, allowing it to move under its own power. A snow clearing mechanism is attached to the body and is in mechanical communication with the motor. The snow clearing mechanism is configured to clear an area of snow it is exposed to. The snow clearing machine is structured such that a surface area of at least one of the body, motive source, and snow clearing mechanism is great enough to prevent a sinking of the machine completely through a quantity of snow beneath the machine. As such, in operation the snow clearing machine can "float" partially over the snow with no part of the snow clearing machine contacts a surface of a roof on which it is operated.

In another aspect, a snow clearing machine may have one or a plurality of rollers, casters, skids, or the like extending beyond a lowest point of the motive source and snow clearing mechanism. This structure extending beyond the lowest point of the motive source may, among other features, provide additional protection in case of failure in operation or user error. In this aspect, the snow clearing mechanism and the motive source machine is prevented from ever making contact with a surface below which the snow clearing machine is being operated on, even in case of a failure or user error—because the rollers, casters, skids, or the like (which are made of softer and less abrasive parts) will contact the surface first, keeping the snow clearing mechanism and motive source elevated.

DETAILED DESCRIPTION

Figure 1:
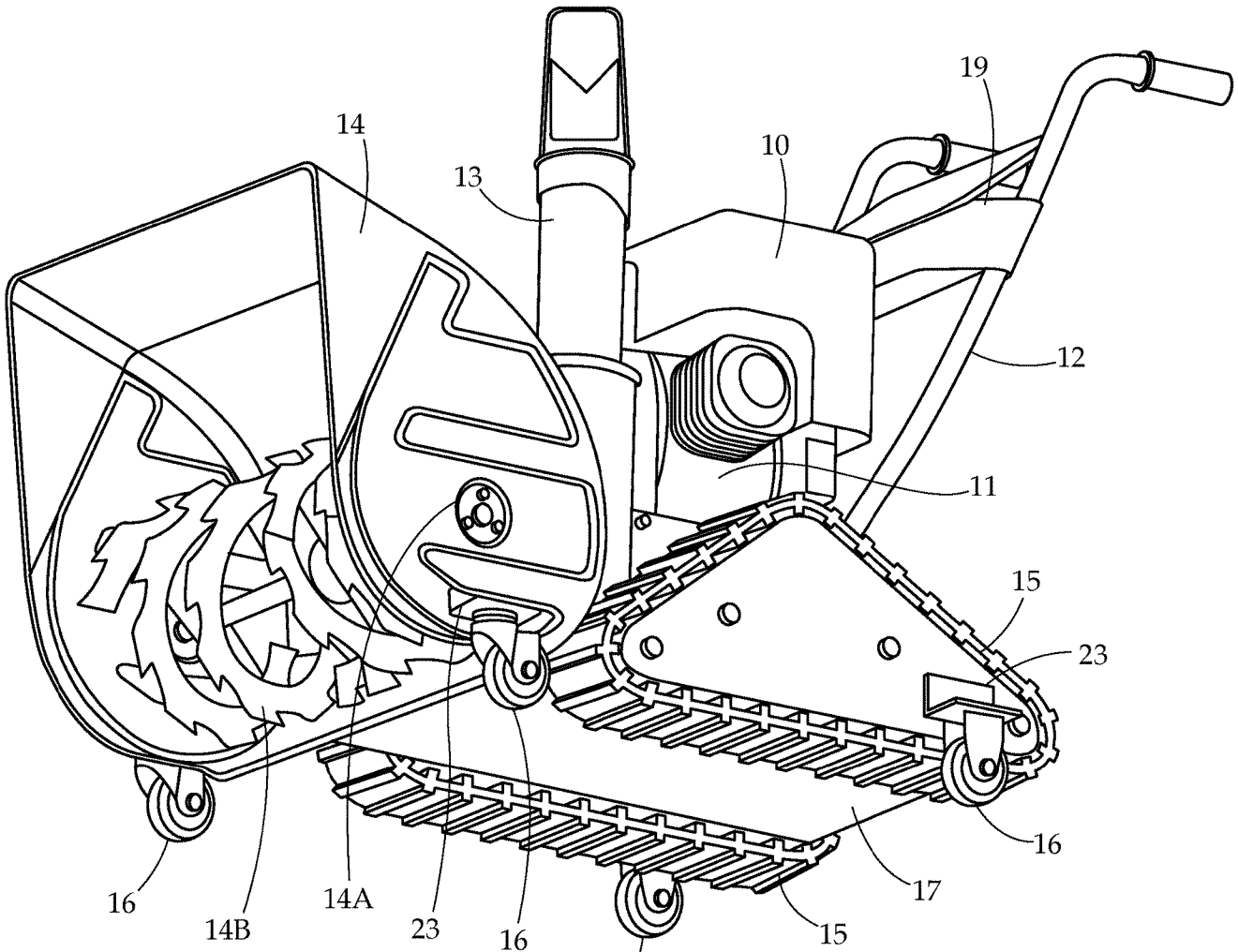
FIG. 1 provides a perspective view of an embodiment of the present invention.

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

Generally, the present invention concerns a snow clearing machine configured to make no contact with a flat roof when in proper operation.

The snow clearing machine is formed generally of a body containing a motor and related operational parts, a motive source such as tracks or drive wheels, handles for control and operation, and a snow clearing mechanism, such as an auger style snow thrower, spinning brush, or plow.

The motor, body, handles (or related controlling structure) and snow clearing mechanisms of the machine contemplated herein may be off-the-shelf, industry standard materials, or may only require minor modifications thereof. Motorized, hand controlled snow clearing machines are known in the art and used for driveways, sidewalks, and the like. However, multiple structural changes are required for roof-top application contemplated by the present disclosure.

The motor of the present invention may be gasoline, electric, or any other motor either known in the art or to be developed. The motor provides energy to both the motive source (such as tracks, wheels, and the like), as well as a powered snow clearing mechanism (such as the auger snow thrower, spinning brush, or the like). Further, in varying embodiments the motor may provide power for operation of various accessories, as described further herein.

The present inventive snow clearing machine is specifically configured for operation on a flat roof. In operation, the snow clearing machine will ensure that a layer of snow is pushed underneath the track system, and will ensure that it does not make contact with the roof when in normal, proper, operation. In effect, the snow clearing machine of the present invention "floats" along the compressed snow surface beneath it, and does not sink therein. This may be achieved in a number of manners.

In one embodiment, a track or tracks may be used as the motive source on the present machine. This track or tracks may be specifically configured to have a surface area to allow the machine to sink into the snow somewhat, but not all the way through the snow. As such, in this embodiment, the tracks will allow the snow clearing machine to leave a layer of snow underneath, and to remove the remaining snow on the roof by guiding the machine along the area of the roof and removing the snow using the snow clearing mechanism of the machine. In a particular embodiment, the track may have an auto turn mechanism to allow for easy turning of the device.

In still a further embodiment, the track or tracks may have free moving rollers at its ends, such that the rollers will not damage the roof surface if accidentally contacting the roof.

In another embodiment, one or a plurality of skis may be connected to a bottom of the machine, allowing it to slide along the snow. These ski or skis may be specifically configured to have a surface area to allow the machine to sink in to the snow somewhat, but not all the way through the snow. This ski embodiment may be used without a motive structure, or may be used in conjunction with a motive structure such as wheels, or the track described above. In one embodiment, the skis may be positioned slightly below a bottom most surface of the snow clearing mechanism, ensuring that the mechanism does not contact the roof. For example, the skis may be approximately 1-4 inches below the snow clearing mechanism. In an embodiment of the machine having both a track motive source and the skis, the track may sit slightly below the skis.

In yet another embodiment, a flat skid surface may be connected to the machine below the motor compartment of the body and below the snow removal mechanism. This flat surface will further prevent the machine from sinking too deeply into the snow because of the added surface area it provides. This surface may be approximately one inch above a bottom of the motive source. This skid embodiment may be used without a motive structure, or may be used in conjunction with a motive structure such as wheels, or the track described above, as well as with the skis described above.

In one embodiment, a plurality of free-playing, retractable casters may be provided on a bottom of the machine. These casters may be retractable, and thus movable from a first extended position, to a second retracted position. In the extended position, the casters may provide easy movement, for example on a dry roof, or on the ground as snow throwers on tracks are extremely difficult to maneuver on dry surfaces. The retractable casters will allow free movement and maneuvering of the snow thrower until it is positioned on the snow. In the retracted position, two embodiments are possible. In a first embodiment, as a precaution against unintended sinking of the machine while on a roof, the casters may extend below a lowest surface of the motive source in the retracted position. As such, even in an event where the machine sinks through the snow and onto the roof surface, the casters will allow a rolling of the machine, such that no damage is provided by the motive source, snow clearing mechanism, or any other part of the machine. In a second embodiment, the casters may be fully retracted above the motive source when in the retracted position. In still another embodiment, the casters may be capable of three positions: extended, safety—being slightly below the lowest point of the motive source, and fully retracted.

In one embodiment, the casters may also be positioned under the snow clearing mechanism. In another embodiment, a single roller extending between the two sides may be positioned below the snow clearing mechanism. In still a further embodiment, a flat plate or ski may be beneath the snow clearing mechanism. In any event, these structures may function to prevent accidental contact between roof and snow clearing mechanism.

One or a number of accessories may be included in varying embodiments of the snow clearing machine. For example, in one embodiment, a manual or automatic adjustment structure may be provided to increase or decrease the distance of a snow throw. Without such an adjustment, the snow thrown might cover a large area outside the building.

In another embodiment, a sensor to measure and track distance of the machine from the roof (amount of snow between the two) may be provided. A warning may be sounded if the distance becomes lower than a set minimum. This sensor may be any sort of distance or proximity sensor, either known or to be discovered.

In yet another embodiment, a sensor may be provided to monitor a distance away from an edge of the roof of the machine. A warning may be sounded if the distance becomes lower than a set minimum. This sensor may be any sort of distance or proximity sensor, either known or to be discovered.

In still another embodiment, a leveling device may be provided on the machine to allow a user to track and monitor the levelness of the machine. This may also be used as a safety to ensure the machine is not used at an angle that will result in the machine gradually approaching the roof surface. In the safety embodiment, the sensor may automatically shut off the machine if it exceeds a certain operating angle.

In yet still another embodiment, an obstacle sensor may be used to ensure that an area directly in front of the machine is clear of pipes, vents, sky lights, and other obstacles. A warning may be sounded if an obstacle is present within a predetermined distance. This sensor may be any sort of distance or proximity sensor, either known or to be discovered.

As will be readily understood, the present invention and its components may be easily assembled and disassembled in order to allow for the lifting between the top of the roof and the ground.

In varying embodiments, a surface area exposed to the snow over which the present invention is operated may be great enough to prevent a sinking of the machine completely through a quantity of snow beneath the machine, such that in operation no part of the snow clearing machine contacts a surface of a roof on which it is operated. Using the physical relation $P=W/A$ for a given snow density, this surface area may be a surface area of tracks providing movement to the device, a skid plate under a body of the device, a ski on the front of the device, combinations of these elements, and the like. In a particular embodiment, the present invention may employ two tracks as the motive source. Each of these tracks may have a downward facing surface area of between approximately 90 to 150 square inches. In a particular embodiment, each of these tracks may have a downward facing surface area of approximately 110 square inches. However, it should be understood that the degree by which the machine may slightly sink into the snow depends on this surface area and the density of the snow conditions common to the operation area. Further, in some embodiments using a skid plate underneath the body of the machine, much greater surface areas may be available. For example, the skid plate may have dimensions of approximately 24 inches by 30 inches—providing a surface area of approximately 720 square inches. In another embodiment, the skid plate may have dimensions of approximately 18 inches by 24 inches—providing a surface area of approximately 432 square inches. In experiments, when the 720 square inch plate was loaded with 200 pounds of weight, almost no sinking (perhaps 0.5 inches) was observed. Similarly, when the 432 square inch plate was loaded with 700 pounds, two inches of sinking was observed. As noted, the present invention seeks to skink approximately 2-4 inches into the snow, and thus its surface area can be calculated accordingly. In still further embodiments, the surface area of the bottom machine may vary between 170 and 220 square inches. To mimic these embodiments, tests were performed with boards having 220, 200, 198, and 176 square inches of surface area. These boards were each loaded with 176.4 pounds, and the depression into the snow was measured as follows:

| Board Dimensions and Surface Area($in^2$) | Weight (lbs) | Initial Height of Snow | ΔH/Depression(in) |
|---|---|---|---|
| 10" × 22" 270 $in^2$ | 176.4 | 17" | 0.5" |
| 10" × 20" 200 $in^2$ | 176.4 | 15" | .75" |
| 9" × 22" 198 $in^2$ | 176.4 | 15" | .75" |
| 8" × 22" | 176.4 | 18" | 1.25" |

The test was performed again on different areas of the same snow, this time with the boards being loaded with 236.4 pounds. The depression in the snow was measured as follows:

| Board Dimensions and SA($in^2$) | Weight (lbs) | Initial Height of Snow | ΔH/Depression(in) |
|---|---|---|---|
| 10" × 22" 220 $in^2$ | 236.4 | 16" | .5" |
| 10" × 20" 200 $in^2$ | 236.4 | 16" | .75" .75 was actually 2.5" when moved a little; |
| 8" × 22" 176 $in^2$ | 236.4 | 15" | 3.0" |
| 5" × 22" 110 $in^2$ | 236.4 | 14.5" | 3.5" 3.5" no change after adding weight |

In operation, the present invention is structured and configured to operate over a layer of snow, clearing any snow in front of it above this level. However, the machine is not intended to pass through this layer of snow over which it operates, thereby protecting the surface below. The operation of the device will be similar to operation of a traditional snow thrower, with the motive source driving the device, and the snow clearing mechanism moving the snow away from the front of the device as it is driven along. However, as noted, the machine will operate on snow, not a solid ground surface as is typical of prior art snow throwers. One difference between the prior art and the present invention is at the beginning of operation. The snow clearing machine will need to be raised up to a surface of the snow, and then rested thereon, so that it can sink into the snow for operation. This may be achieved in any number of ways. For example, in one embodiment, the machine may be lifted and placed on a surface of the snow. In another embodiment, the machine may be driven up a ramp to an elevated position, and then off the edge of the ramp onto the snow. In yet another embodiment, a user may angle the device upward by leaning on the handles as a lever, allowing the machine to crawl up the snow to a surface of the snow.

Turning now to FIG. 1, a perspective view of an embodiment of the snow clearing machine is provided. The snow clearing machine has body 10 housing motor 11, and providing the base to which the various elements of the machine are connected. Snow clearing mechanism 14 is shown here as an auger snow clearing mechanism. The auger 14B is rotatable about axis 14A and powered by motor 11. A snow chute 13 is in communication with the housing of the snow clearing mechanism 14 and in operation, the chute 13 directs snow ejected from the auger snow clearing mechanism 14. A pair of tracks 15 operate as the motive source. The tracks 15 are in mechanical communication with the motor 11 and thus powered. In many embodiments, the tracks 15 have a bottom facing surface area great enough to allow the machine to sink into the snow somewhat, but not all the way through the snow. A flat skid plate 17 is positioned below the body 10 to provide additional surface area to prevent the machine from sinking too deeply into the snow on which it is operated. Handles 12 extend from the body 10 and allow an operator to manipulate and control the machine. An instrument panel 19 is positioned on the handles and may hold one or a number of displays and gauges of various accessories.

A plurality of casters 16 are positioned about the exterior of the machine. The casters 16 may operate as a safety feature to prevent the device from accidentally damaging a surface that it is operating on. Specifically, in an event that the snow gives way and the machine sinks through the snow onto the surface below (such as a roof), the soft casters will prevent any part of the machine's operational parts (namely tracks 15 and auger system 14) from contacting the surface. Casters 16 are attached to the parts of the machine by brackets 23. These brackets 23 may allow for a fixed position of the casters 16 in one embodiment, and may allow for multiple retracted positions of the casters in other embodiments. In varying embodiments, the casters may be fixed in direction, or may be freely rotatable.

Figure 2:
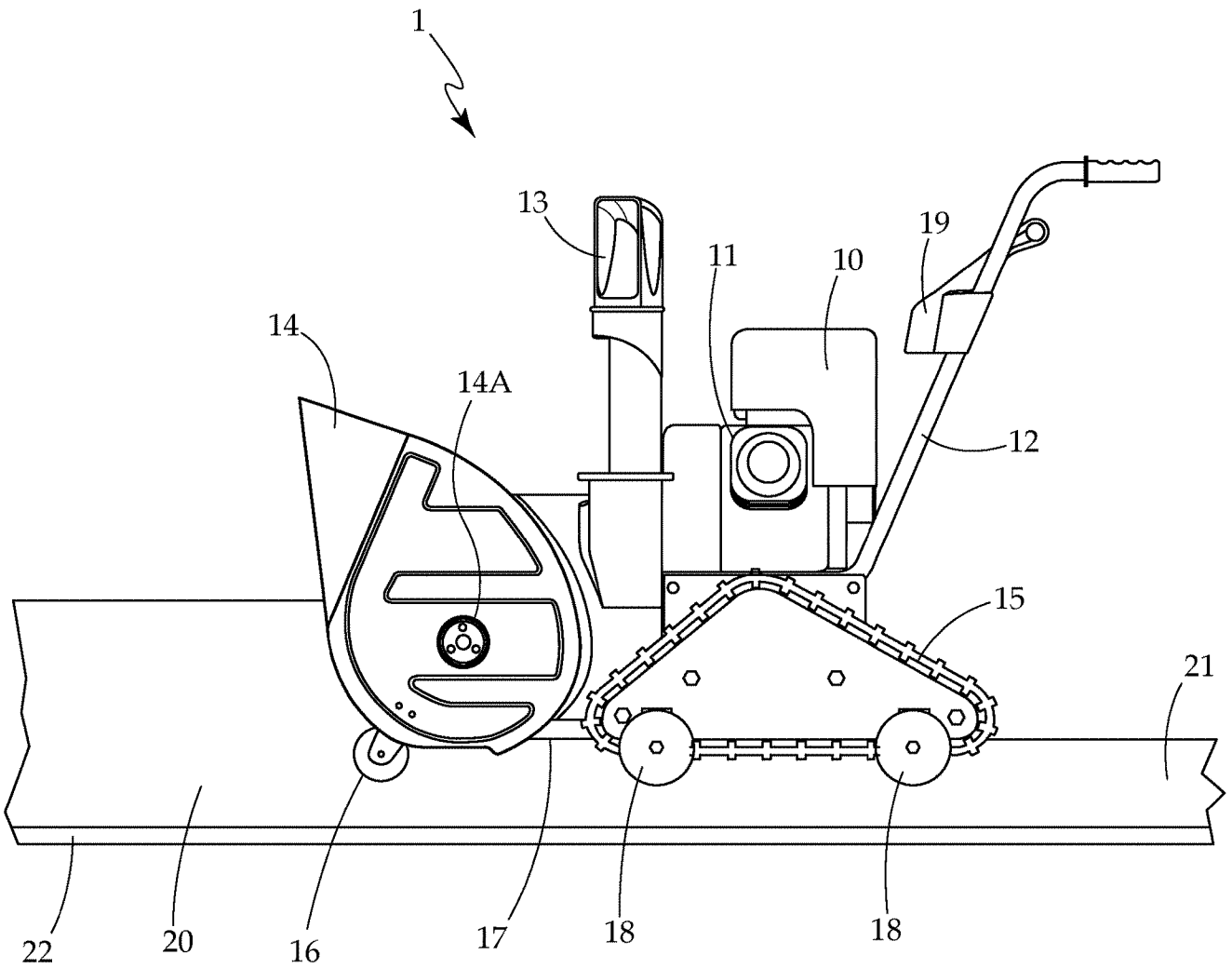
FIG. 2 provides a side view of another embodiment of the present invention.

FIG. 2 shows another embodiment of the snow clearing machine of the present invention in an operative mode. In this view, the machine can be seen gliding over the snow 21 underneath it, and clearing the snow 20 in front of the snow clearing mechanism 14. In the condition shown in FIG. 2, the snow clearing machine 1 is in operation above a roof 22. Caster 16 and wheels 18 have a lowest surface below that of the tracks 15 or auger system 14. As such, in the event that the snow clearing machine 1 falls through the snow 21 beneath it, the caster 16 or wheels 18 will contact the roof 22 before any other operative system, thereby preventing any damage to the roof 22. Further, it should be understood that the machine will operate similarly regardless of the structure beneath the motive source and snow clearing mechanism as discussed elsewhere in this disclosure.

Figure 3:
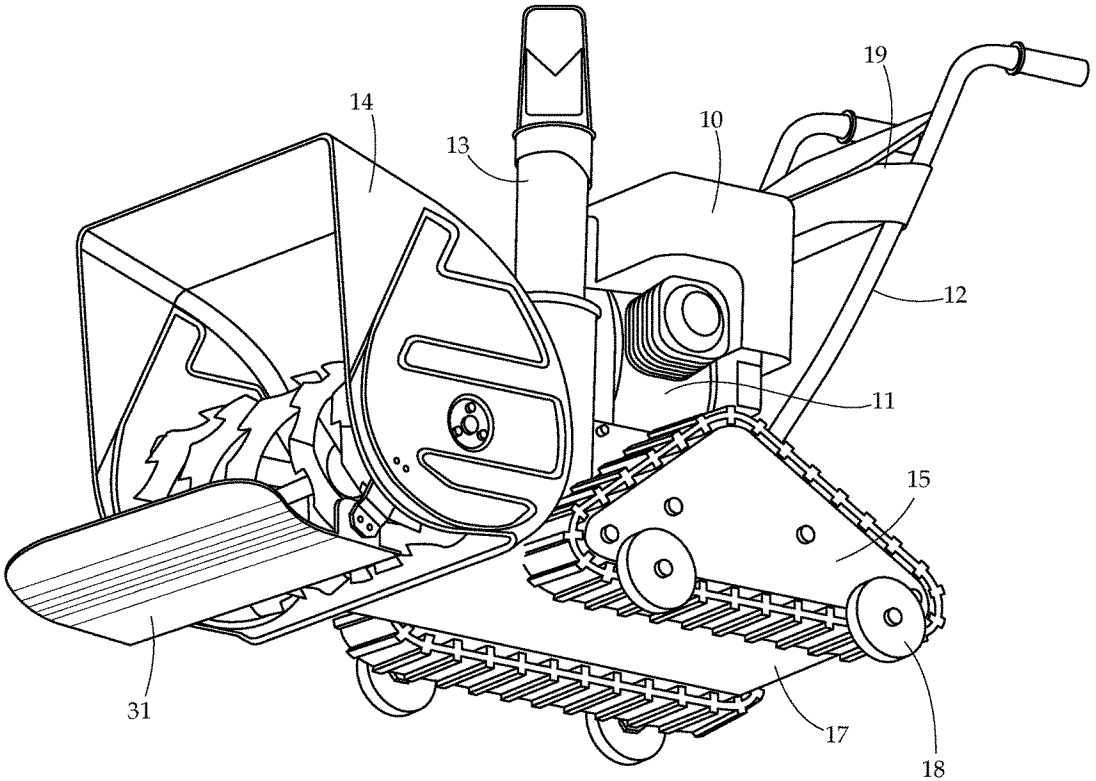
FIG. 3 provides a perspective view of yet another embodiment of the present invention.

FIG. 3 provides another view of an embodiment of the present invention. In this view, safety wheels 18 are below the track 15. In addition, a ski type plate 31 is positioned below the auger snow clearing mechanism 14. The ski plate 31 has a flat base and an upwardly curving front end, allowing it to glide over the snow and to elevate the snow clearing mechanism 14 above the operating surface as a safety precaution. The shape of the plate will allow a layer of snow to accumulate under the tracks, thereby preventing the machine from coming into contact with the roof surface. It should be understood that in some embodiments, the ski 31 may be differently shaped. For example, the ski 31 may be just a flat plate without any upward curving. It should further be understood that any of the wheels 18 or casters 16 may be replaced with ski plates 31 depending on embodiment and without straying from the scope of the present invention.

Figure 4:
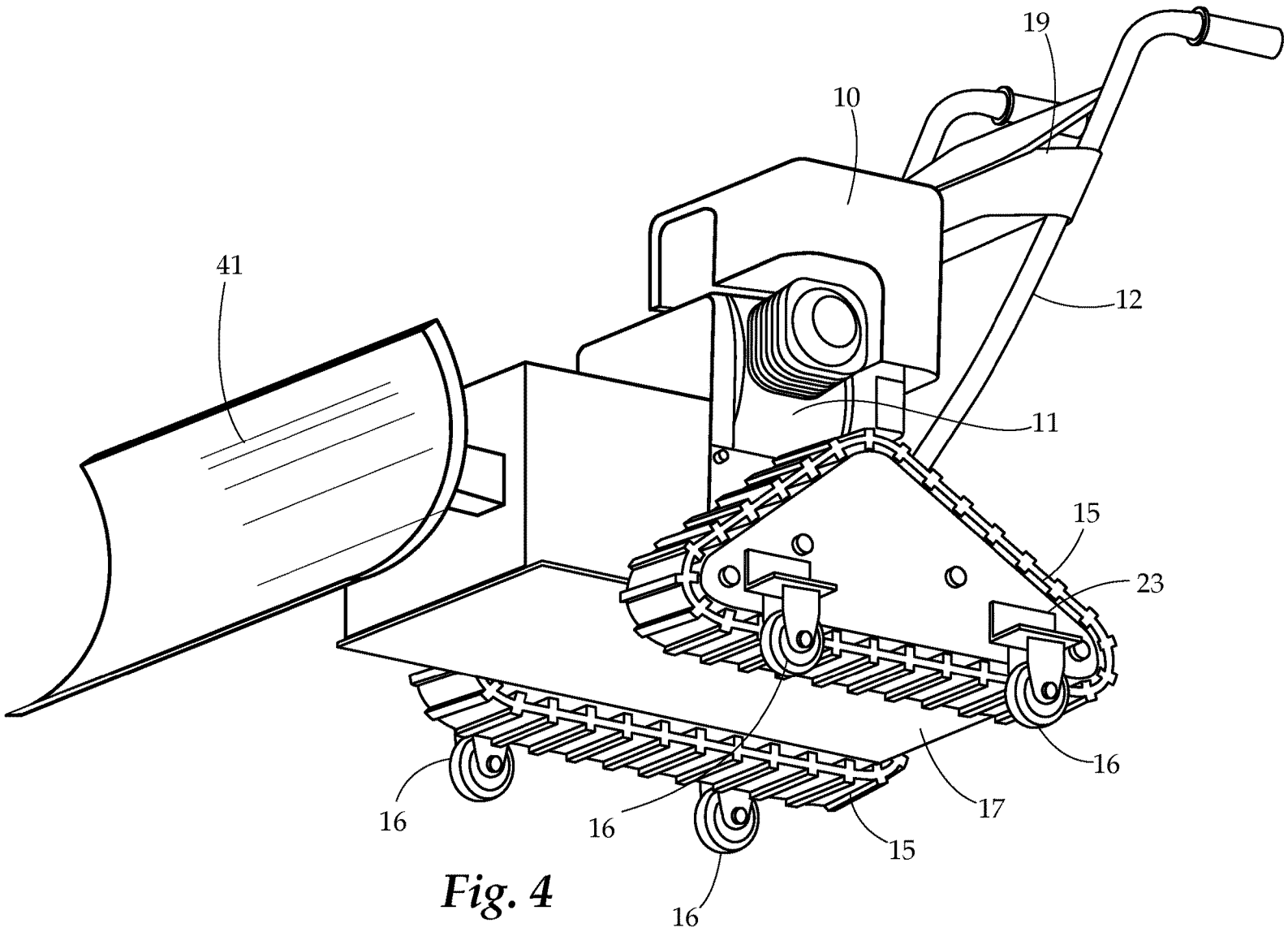
FIG. 4 provides a perspective view of still another embodiment of the present invention.

FIG. 4 provides a perspective view of still another embodiment of the present invention. In this embodiment, the snow clearing mechanism is a plow 41. In operation, the tracks 15 drive the device and the plow 41 pushes the snow out of the way of the device as it moves.

Figure 5:
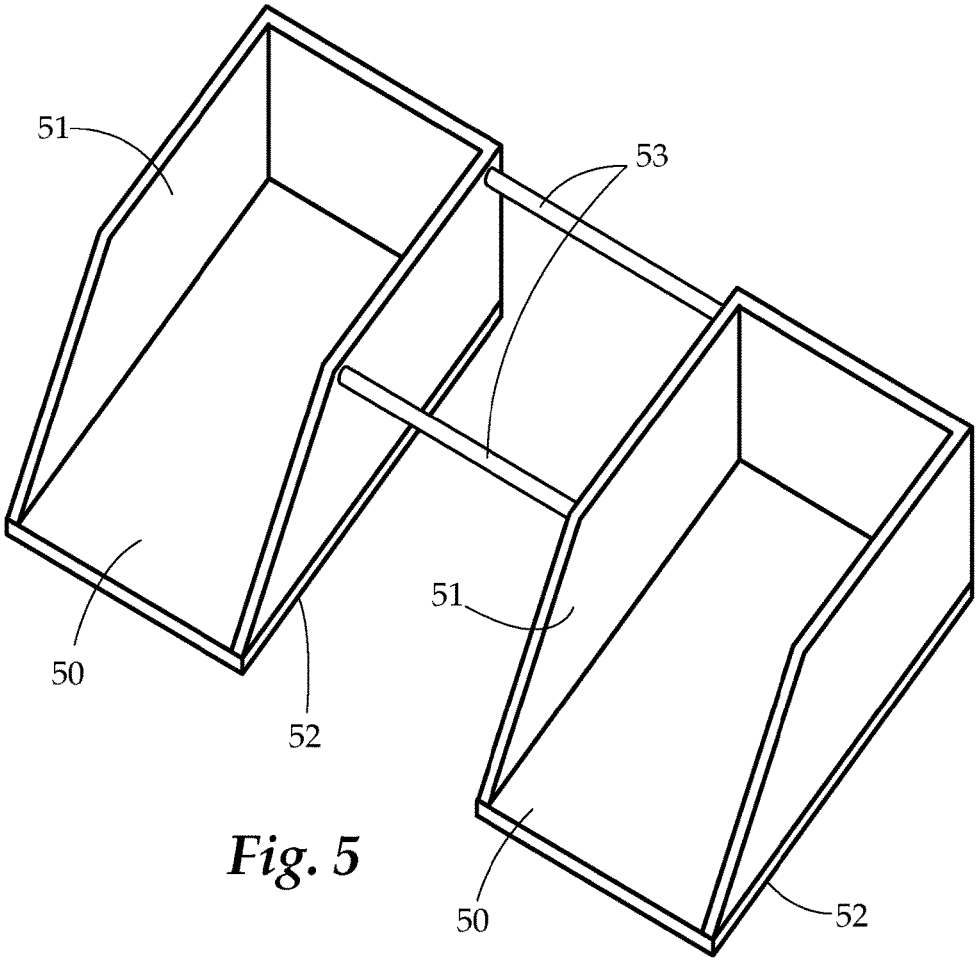
FIG. 5 provides an embodiment of a ramp for use with the present invention.

FIG. 5 provides a perspective view of a ramp for use with the snow clearing machine of the present invention. The ramp is designed to elevate the snow clearing machine to at or near a top of the snow. Upon driving the machine off the ramp, it will sink into the snow somewhat, but not all the way. The machine can then be used to clear the snow ahead of it. The ramp comprises two blocks 50 aligned with a track or other motive source. The angled regions 51 allow the machine to be driven up to an elevated position. The blocks 50 are held together by bars 53. On a bottom of each block 50 is a pad 52 or other substance to protect a surface on which the ramp is operating, such as a roof.

Figure 6:
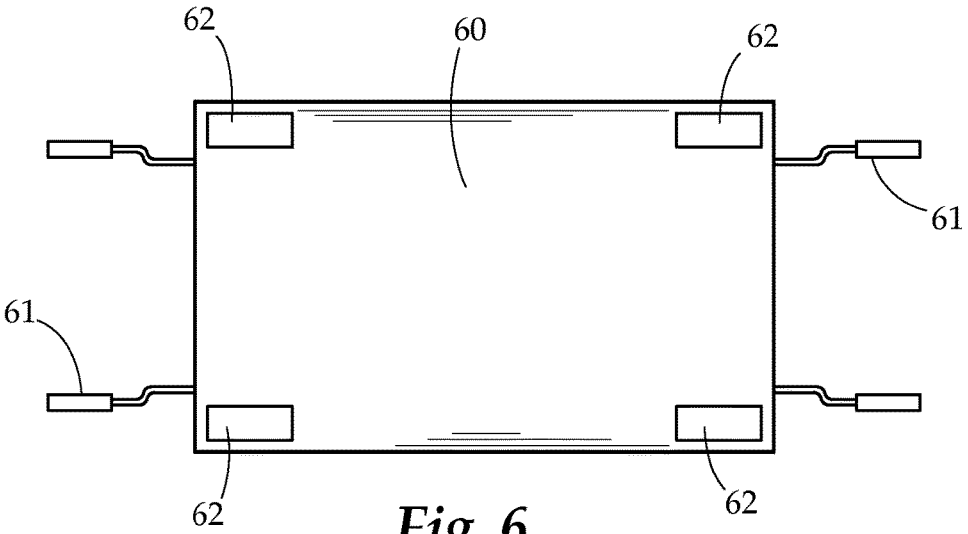
FIG. 6 provides an embodiment of a platform for use with the present invention.

FIG. 6 provides a lift platform for use with the snow clearing machine of the present invention. The lift platform is configured to have the snow clearing machine placed on it, and then lifted onto a top surface of the snow. Once on the top of the snow, it will sink in somewhat but not through the snow, the machine may then be driven off the platform for clearing operation. The platform 60 includes handles 61 on each side. Further, it may optionally have a protrusion 62 to hold wheels in place, or some similar securing structure.

Figure 7:
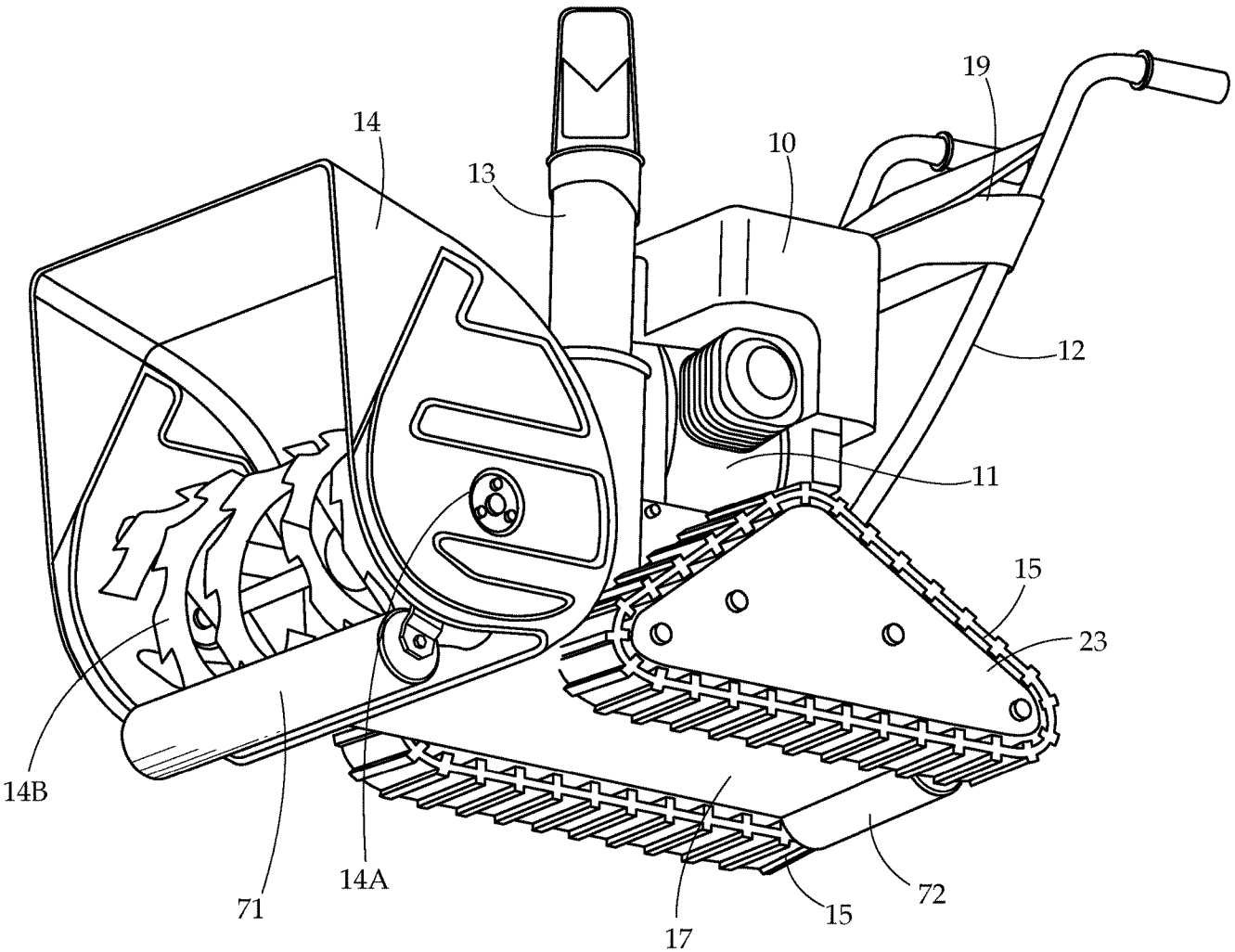
FIG. 7 provides a perspective view of an embodiment of the present invention.

FIG. 7 provides a perspective view of another embodiment of the snow clearing machine. The snow clearing machine has body 10 housing motor 11, and providing the base to which the various elements of the machine are connected. Snow clearing mechanism 14 is shown here as an auger snow clearing mechanism. The auger 14B is rotatable about axis 14A and powered by motor 11. A snow chute 13 is in communication with the housing of the snow clearing mechanism 14 and in operation, the chute 13 directs snow ejected from the auger snow clearing mechanism 14. A pair of tracks 15 operate as the motive source. The tracks 15 are in mechanical communication with the motor 11 and thus powered. In many embodiments, the tracks 15 have a bottom facing surface area great enough to allow the machine to sink into the snow somewhat, but not all the way through the snow. A flat skid plate 17 is positioned below the body 10 to provide additional surface area to prevent the machine from sinking too deeply into the snow on which it is operated. Handles 12 extend from the body 10 and allow an operator to manipulate and control the machine. An instrument panel 19 is positioned on the handles and may hold one or a number of displays and gauges of various accessories.

A front roller 71 is positioned underneath the now clearing mechanism 14. The front roller 71 may compress the snow underneath it, and may also operate as a safety feature to prevent the device from damaging a surface that it is operating on. Specifically, in an event that the snow gives way and the machine sinks through the snow onto the surface below (such as a roof), the front roller 71 will prevent any part of the machine's operational parts (namely tracks 15 and auger system 14) from contacting the surface. Similarly, a rear roller 72 is positioned on the flat plate, and extends below the lower surface of the tracks 15. The rear roller operates as the front roller 71 does, allowing movement of the machine over a non-snow surface, and protecting the surface below the operation of the machine.

Figure 8:
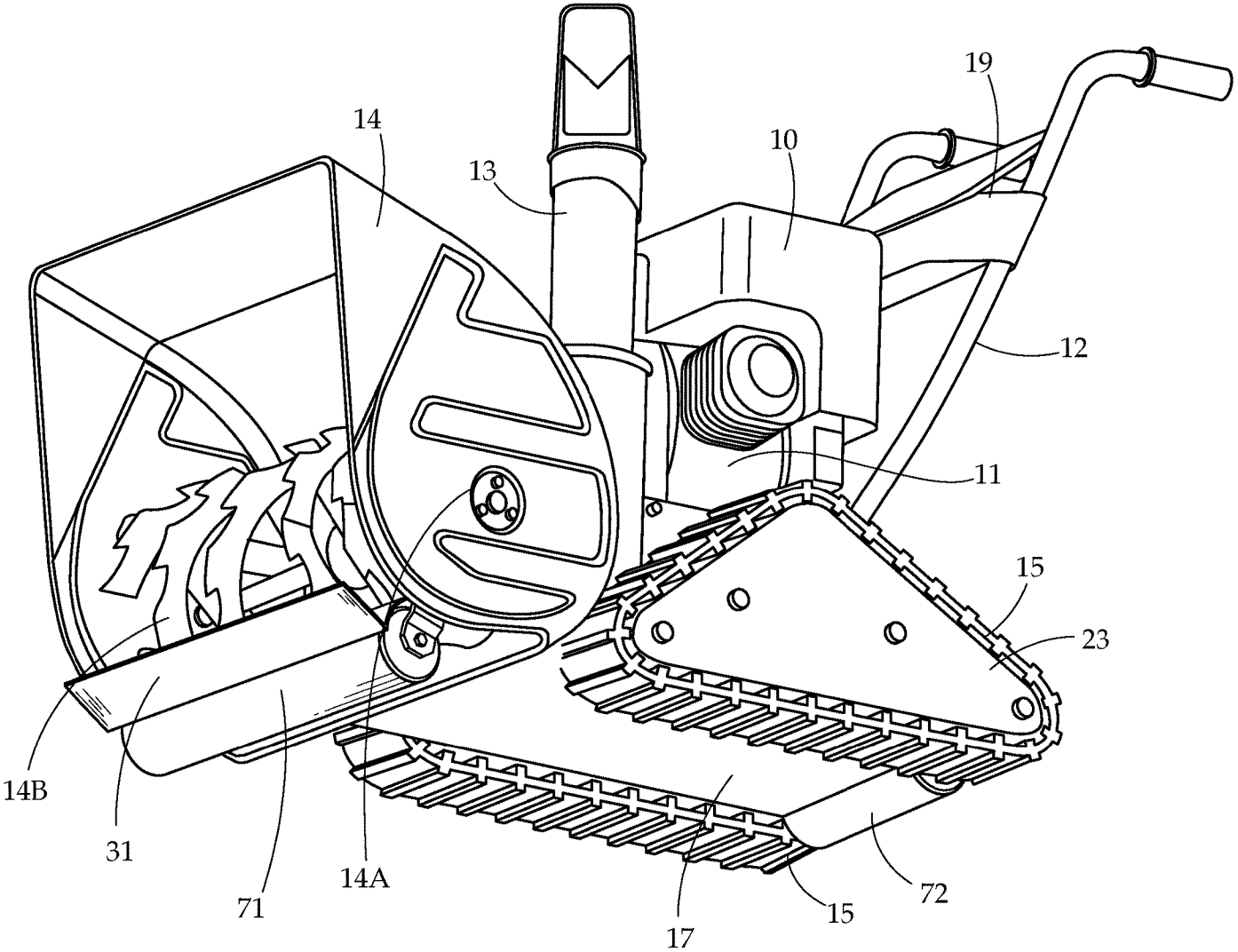
FIG. 8 provides a perspective view of an embodiment of the present invention.

FIG. 8 provides another view of an embodiment of the present invention. In this view, front roller 71 and rear roller 72 are below the track 15. In addition, a ski type plate 31 is positioned below the auger snow clearing mechanism 14. The ski plate 31 has a flat base and an upwardly curving front end, allowing it to glide over the snow and to elevate the snow clearing mechanism 14 above the operating surface as a safety precaution. The ski plate will also serve to push some amount of snow underneath the front roller, thereby creating a layer of compressed snow to remain underneath the tracks. It should be understood that in some embodiments, the ski 31 may be differently shaped. For example, the ski 31 may be just a flat plate without any upward curving. It should further be understood that any of the front or rear roller 71, 72, may be replaced with ski plates 31 depending on embodiment and without straying from the scope of the present invention.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. A flat roof snow clearing machine comprising:

a body providing a primary structure of the machine;

a motor within the body;

handles attached to the body;

a motive source attached to the body, providing a source of movement to the snow clearing machine and being in mechanical communication with the motor;

a snow clearing mechanism attached to the body and in mechanical communication with the motor, the snow clearing mechanism configured to clear an area of snow it is exposed to; and a ski plate positioned below the snow clearing mechanism and extending across the snow clearing mechanism, the ski plate having an upwardly angled or upwardly curved front edge and configured to urge a quantity of snow underneath the motive source and underneath the snow clearing mechanism.

2. The flat roof snow clearing machine of claim 1 wherein the motive device is at least one track, the at least one track having a bottom facing surface area in a range of 90 to 150 square inches.

3. The flat roof snow clearing machine of claim 1 wherein the snow clearing mechanism is an auger snow clearing mechanism having a housing, a chute in communication with the housing and an auger rotatable within the housing and in communication with the motor.

4. The flat roof snow clearing machine of claim 3 further comprising a snow throw controller on the chute, the snow throw controller configured to modify a distance and direction of snow passing through the chute.

5. The flat roof snow clearing machine of claim 1 wherein the snow clearing mechanism is a plow.

6. The flat roof snow clearing machine of claim 1 further comprising a height sensor, the height sensor powered by the motor and configured to measure a distance between the snow clearing machine and a surface of the roof, and further configured to provide an alarm output upon measuring a distance below a predetermined distance minimum.

7. The flat roof snow clearing machine of claim 1 further comprising an edge sensor, the edge sensor powered by the motor and configured to measure a distance between the snow clearing machine and an edge end of the roof, and further configured to provide an alarm output upon measuring a distance below a predetermined distance minimum.

8. The flat roof snow clearing machine of claim 1 further comprising a level configured to provide an output of how level the snow clearing machine is.

9. The flat roof snow clearing machine of claim 1 further comprising a level sensor powered by the motor and configured to measure an operating angle of the machine, the level sensor further configured to provide an alarm output upon measuring an operating angle greater than a predetermined maximum.

10. The flat roof snow clearing machine of claim 1 further comprising a plurality of casters attached to the body.

11. The flat roof snow clearing machine of claim 1 further comprising a front roller positioned beneath the snow clearing mechanism.

12. The flat roof snow clearing machine of claim 1 further comprising an obstacle sensor powered by the motor and configured to identify an obstacle in front of the snow clearing mechanism, the obstacle sensor further configured to provide an alarm output upon measuring an obstacle.

13. A flat roof snow clearing machine comprising:

a body providing a primary structure of the machine;

a motor within the body;

handles attached to the body;

a motive source attached to the body, providing a source of movement to the snow clearing machine and being in mechanical communication with the motor;

a snow clearing mechanism attached to the body and in mechanical communication with the motor, the snow clearing mechanism configured to clear an area of snow it is exposed to;

a height sensor, the height sensor powered by the motor and configured to measure a distance between the snow clearing machine and a surface of the roof, and further configured to provide an alarm output upon measuring a distance below a predetermined distance minimum, and a plurality of at least one of rollers, casters, and skids in a fixed height wise position extending beyond a lowest point of the motive source.

14. The flat roof snow clearing machine of claim 13 further comprising an edge sensor, the edge sensor powered by the motor and configured to measure a distance between the snow clearing machine and an edge end of the roof, and further configured to provide an alarm output upon measuring a distance below a predetermined distance minimum.

15. The flat roof snow clearing machine of claim 13 further comprising a level configured to provide an output of how level the snow clearing machine is.

16. The flat roof snow clearing machine of claim 13 further comprising a front roller positioned beneath the snow clearing mechanism.

17. The flat roof snow clearing machine of claim 13 wherein the motive device is at least one track, the at least one track having a bottom facing surface area in a range of 90-150 square inches.

* * * * *